United States Patent [19]

Seidl

[11] Patent Number: 4,783,595

[45] Date of Patent: Nov. 8, 1988

[54] SOLID-STATE SOURCE OF IONS AND ATOMS

[75] Inventor: Milos Seidl, Wayne, N.J.

[73] Assignee: The Trustees of the Stevens Institute of Technology, Hoboken, N.J.

[21] Appl. No.: 716,896

[22] Filed: Mar. 28, 1985

[51] Int. Cl.[4] ..... H01J 27/00

[52] U.S. Cl. ..... 250/423 R; 315/111.81

[58] Field of Search ..... 315/111.81; 250/423 R, 250/423 F; 313/230, 359.1, 360.1

[56] References Cited

U.S. PATENT DOCUMENTS

| | | | |
|---|---|---|---|
| 3,465,522 | 9/1969 | Anderson | 60/202 |
| 4,031,606 | 6/1977 | Szonntagh | 29/570 |
| 4,041,220 | 8/1977 | Armand | 429/191 |
| 4,169,351 | 10/1979 | Barber | 60/203 |
| 4,395,631 | 7/1983 | Salisbury | 250/251 |
| 4,595,835 | 6/1986 | Boulin et al. | 250/423 R |

FOREIGN PATENT DOCUMENTS

| | | | |
|---|---|---|---|
| 165238 | 9/1983 | Japan | 250/423 R |

OTHER PUBLICATIONS

Design and Operating Characteristics of a Simple Alkali Ion Gun by Terzic, Tosic, and Ciric, Nuclear Instr. and Meth. 137 No. 1 (8/15/1976) pp. 11–14.

J. Vukanic and I. Terzic,. *Nuclear Instruments and Methods,* vol. 111, pp. 117–124 (1973).

M. Kaminsky, *Atomic and Ionic Impact Phenomena on Metal Surfaces,* (Academic Press, New York, 1965) pp. 19–20, 110–115.

O. Heinz and R. T. Reaves, *Rev. Sci. Instrum.* 39, 1129–1230 (Aug., 1968);

G. R. Brewer, *Ion Propulsion Technology and Application,* (Gordon and Breach, 1970) pp. 102–105;

D. W. Hughes et al. *Rev. Sci. Instrum. 51,* 1471–72 (Nov. 1980).

*Zeolon Acid Resistant Molecular Sieves* Norton Company. Akron, Ohio (1976).

*Catalyst Bases LZ-M-5 and LZ-M-8 Powders* Union Carbide, Danbury, Connecticut.

R. Richter *Ion Engine with Solid-Electrolyte Ion Generator* NASA Tech Briefs, vol. 8, No. 2, p. 99 (1983).

*Standard Handbook for Electrical Engineers* p. 23. "The Ion Engine", (1978).

A. N. Pargellis et al. *Thermionic Emission of Alkali Ions from Zeolites* J. Appl. Phys. 53(9), 4933–4938. (Sep., 1978).

J. Motossian et al. *Enhanced Emission of Positive Cesium Tons from Zeolite* J. App. Phys. 53 (9) pp. 6376–6382, Sep. 1982.

James M. E. Harper "Ion Beam Deposition" *Thin Film Processes* pp. 175–206 (1978).

R. Richter "Ion Engine with Solid-Electrolyte Ion Generator" *Technical Support Package* (1983).

*Primary Examiner*—Samuel Scott

*Assistant Examiner*—Noah Kamen

*Attorney, Agent, or Firm*—Pennie & Edmonds

[57] ABSTRACT

A source (100, 101, 200, 300, 400) of a beam of positive ions or atoms comprises an ion-emission pellet (1, 401) consisting essentially of a solid electrolyte. Preferred solid electrolytes for the pellet (10, 49) are alkali or alkali-earth mordenites. A pellet heater is capable of heating the pellet (1, 401) to an ion-emission temperature at which ions are emitted from the pellet. A beam-forming electrode (2, 4, 31, 60) contacts an ion-emission surface (22) of the pellet (1, 401). The beat-forming electrode (2, 4,31, 60) has at least one passageway extending through it into which ions from the ion-emission surface (22) can pass. Ions emitted into the passageway are discharged from the source as unneutralized ions or neutralized atoms. The ion-emission surface (22) of the pellet (1) may optionally be coated with a layer (2, 31) of porous tungsten or other refractory, high-work-function material to establish an essentially equal potential across the surface (22) and to neutralize ions emitted from the surface (22) when the source (101, 300) is operated as an atom source.

28 Claims, 3 Drawing Sheets

SOLID-STATE SOURCE OF IONS AND ATOMS

TECHNICAL FIELD

The present invention relates to a device that produces a beam of positive ions or atoms of elements that have a sufficiently low ionization potential.

BACKGROUND OF THE INVENTION

Ion sources have a number of uses in industry and research. For example, they are used in secondary ion mass spectrometers, ion microprobes, heavy ion probes, fast atom bombardment mass spectroscopes, and in microelectronic circuit fabrication and for space propulsion.

One type of ion source is the contact or surface ionization ion source. Contact ionization ion sources typically produce beams of cesium ions. A conventional contact ionization ion source for cesium ions is shown in G. R. Brewer, *Ion Propulsion: Technology and Applications,* (Gordon and Breach, 1970), pp. 102–105. The contact ionization ion source includes a contact ionizer composed of grains of a refractory metal such as tungsten which are pressed and sintered into a porous matrix. The ion source also includes an oven for vaporizing cesium metal and a heated manifold which connects the oven to the porous matrix of refractory material. Cesium is vaporized in the oven at a temperature of about 300° C. and conducted to one side of the contact ionizer by way of the heated manifold. The cesium atoms flow into the voids between the grains of tungsten of the ionizer and, depending on the temperature and other factors, interact with the tungsten and become ionized. The cesium evaporates from the ionizer as ions. A disadvantage of such contact ionization ion sources is the requirement of an oven for containing and heating a supply of cesium to vaporize the cesium and a heated manifold to conduct the cesium vapor to the ionizer.

When solid alkali and alkali-earth electrolytes are heated to a temperature of about 900° C. or greater, they typically emit positive ions. This thermionic emission phenomenon has been exploited to construct solid state ion sources.

An example of a thermionic emission solid state ion source is described in O. Heinz and R. T. Reaves, "Lithium Ion Emitter for Low Energy Beam Experiments," *Rev. Sci. Instr.,* vol. 39, pp. 1229–1230 (August 1968). In the Heinz and Reaves article, a lithium ion emitter is disclosed for low energy ion beam experiments. The emitter includes a highly porous tungsten plug mounted on a molybdenum body. A cavity in the molybdenum body contains a heater coil potted in high purity $Al_2O_3$ for heating the porous tungsten plug indirectly. One of the two lithium-ion-emitting compounds, beta-eucryptite ($Li_2O.Al_2O_3.2SiO_2$) or spodumene ($Li_2O.Al_2O_3.4SiO_2$), is melted into the porous tungsten plug. When the plug containing beta-eucryptite or spodumene is heated to a temperature in excess of about 900° C., positive lithium ions are emitted from the surface of the plug. In FIG. 2 of the article a circuit incorporating the lithium-ion emitter is shown. The emitter is located in front of and spaced apart from a grid electrode, which in turn is located in front of and spaced apart from a target electrode. The entire emitter assembly is biased above ground. The grid electrode is biased at below ground and the target electrode is grounded.

Another example of a thermionic emission solid state ion source is described in D. W. Hughes, R. K. Fenney, and D. N. Hill, "Aluminosilicate-Composite Type Ion Source of Alkali Ions," *Rev. Sci. Instr.,* vol. 51, pp. 1471–1472 (November 1980). The source includes a layered pellet prepared by sintering a layered mixture of varying amounts of molybdemum metal powder and a powdered aluminosilicate containing an oxide of the desired alkali element. The concentration of the aluminosilicate increases relative to the metal layer-by-layer from zero percent aluminosilicate in a base layer to fifty percent by weight molybdenum–fifty percent by weight aluminosilicate in a top layer. The pellet is bonded to a modified cathode heater assembly by brazing the pure molybdenum base layer of the pellet to a surface of the heater assembly. The resulting ion emitter assembly is mounted behind a set of electrostatic focusing and accelerating electrodes.

A disadvantage of conventional thermionic solid state ion sources is that the energy of the ions emitted from such conventional ion sources is not well defined due to a voltage drop across the ion-emitting material. Furthermore, the thickness of the ion-emitting material must be kept small to ensure that the voltage drop across the ion-emitting material is acceptable. However, having a small thickness of the ion-emitting material limits the average useful lifetime of such sources since the number of ions that can be stored in the ion-emitting material is limited.

SUMMARY OF THE INVENTION

The present invention relates to a solid state source of positive ions or atoms of elements that have a low ionization potential. The ion source of the invention comprises an ion-emission pellet, a beam forming electrode, and a pellet heater.

The ion-emission pellet is capable of emitting positive ions upon being heated to an ion-emission temperature. The pellet consists essentially of an alkali or alkali-earth electrolyte that is solid at the ion-emission temperature. The pellet has an ion-emission surface from which ions can be emitted.

The beam forming electrode is in electrical contact with the ion-emission pellet at the ion-emission surface for imposing an electrical potential on the ion-emission surface. The beam forming electrode has at least one passageway extending through it to define a beam-transmission channel through which an atom or ion beam can pass. The beam forming electrode is made of an electrically-conductive material which is mechanically stable at the ion-emission temperature.

The pellet heater is adapted to heat the ion-emission pellet to the ion-emission temperature.

When the ion-emission pellet is heated to the ion-emission temperature by the pellet heater, positive ions are emitted from the ion-emission surface into the beam-transmission channel of the ion-beam forming electrode. The ions are discharged from the source unneutralized as an ion beam or are neutralized and discharged as a beam of atoms.

The electrical contact between the beam forming electrode and the ion-emission surface of the pellet ensures that the ion-emission surface of the pellet is approximately an equipotential surface regardless of the dimensions of the pellet. Although there can be a potential variation over the ion-emission surface in certain embodiments of the invention in which the surface is uncoated due to an ohmic potential drop along the ion emission surface, the potential variation is generally sufficiently small not to cause an unacceptably large spread in the energy of the ions produced by the source for many applications.

An advantage of the thermionic solid-state ion source of the invention over prior-art thermionic solid-state ion sources is the fact that the spread in energy of the ions does not depend upon the dimensions of the pellet generally normal to the surface from which the ions are emitted. It is therefore possible to have ion sources of the invention with a large solid-state reservoir of ions. It has been found that it is possible to make solid-state ion sources of the present invention with lifetimes of many hundred hours.

In one embodiment of the ion/atom source of the invention, the ion-emission surface of the pellet is coated with a thin, porous layer of a refractory, high-work-function metal such as tungsten. The passageways of the porous ion-emission metal layer are large enough to pass ions and atoms of the desired element. The passageways comprise at least part of the beam-transmission channel of the ion-beam forming electrode. The ion-emission metal layer is preferably deposited on the ion-emission surface under conditions which give rise to a randomly porous metal layer. Alternatively, the porous ion-emission metal layer can be made of a non-porous metal film into which a dense array of holes have been etched.

If the temperature of the porous ion-emission metal layer is maintained below a certain critical temperature, the ions emitted from the pellet tend to combine with electrons from the metal layer, become neutralized and pass from the metal layer as atoms. The critical temperature depends upon the electronic work function of the metal layer, the thickness and porosity of the metal layer, the dimensions of the pores, the ionization potential of the ions emitted by the pellet and the rate at which ions are emitted from the pellet. If the temperature of the porous metal layer is raised above the critical temperature, ions tend to pass through the metal layer without being neutralized and therefore pass from the metal layer as ions.

Since the surface of the porous metal layer is essentially a true equipotential, the energy spread of the ions produced by the source when the temperature of the metal layer is above the critical temperature is very small. For example, when a porous-tungsten-coated ion-emission surface is about 1000° C., the energy spread of ions passing from the coating is only about 0.1 eV, which is the thermal energy spread corresponding to the 1000° C. operating temperature. Such a low energy spread makes it possible to produce very high quality ion beams that can be well focused. Moreover, the energy spread of the ions is independent of the size of the pellet.

In the case in which ions, as opposed to neutral atoms, exit from the beam-transmission channel of the beam forming electrode, it is preferable to apply an ion acceleration electric field to the ions to focus and accelerate them. Such an ion acceleration electric field is preferably produced by applying an ion acceleration potental difference between an ion-acceleration electrode and the beam forming electrode of the source. The ion-acceleration electrode is preferably proximate to the beam forming electrode and electrically separated from the beam forming electrode. The ion-acceleration electrode is negatively biased with respect to the beam forming electrode so that positive ions emitted from the ion-emission metal layer are accelerated by the ion acceleration electric field established between the beam forming electrode and the ion-acceleration electrode and travel toward an aperture in the ion-acceleration electrode.

The ion-emission pellet optionally has a flux-control surface at a position generally opposing the ion-emission surface and the ion/atom source of the invention optionally includes a flux-control electrode which makes electrical contact with the flux-control surface. The flux-control surface is preferably coated with a layer of refractory metal. Ordinarily, the metal layer on the flux-control surface is not porous, although it may be porous if desired. Alternatively, the flux-control surface of the ion-emission pellet can be uncoated and a flux-control contact terminal which mechanically contacts the flux-control surface can serve as the flux-control electrode.

When the ion/atom source of the invention includes a flux-control electrode, a flux-control electrical connector is connected to the ion-emission electrode and to the flux-control electrode to permit a flux-control voltage source to be electrically connected between the ion-emission electrode and the flux-control electrode. The flux-control voltage source is used to impose a flux-control potential difference between the two electrodes so that the ion-emission electrode is at a lower potential than the flux-control electrode. The magnitude of the flux-control potential difference can be used to control the magnitude of the flux of ions emitted through the ion-emission surface of the ion-emission pellet and hence to control the intensity of the ion or atom beam generated by the ion/atom source.

Preferably, the pellet heater comprises a helical resistance-wire heating element which surrounds the ion-emission pellet. Alternatively, the pellet heater can comprise a resistance-wire heating element which is located in a heater cavity which extends into the body of the ion-emission pellet. Preferably, the pellet and the pellet heater are surrounded by a heat shield. Other types of heat sources may be used if desired.

The ion source of the present invention permits the advantages of a contact ion source to be combined with the use of a solid electrolyte. Since the energy of the ions or atoms generated by the source is not dependent upon the dimensions of the ion-emission pellet, large pellets can be used to obtain ion sources with long lifetimes. Moreover, the source of the invention allows for easy replacement of the solid electrolyte pellet after the ion population has been depleted. Preferred ion sources of the invention can be operated in an ultra-high vacuum and can also be exposed to air without experiencing significant detrimental effects. Preferred sources of the invention produce a well-focused beam of ions or atoms with an energy and intensity that is easily regulated.

BASIC PARAMETERS OF THE INVENTION

The ion-emission pellet of the ion/atom source of the invention consists essentially of a solid electrolyte which contains a desired alkali or alkali-earth ion. Many of the aluminosilicate compounds of the zeolite family are suitable solid electrolytes for the ion-emission pellet. Zeolites of the mordenite type are especially preferred, since the crystal structure of mordenite contains channels of about seven angstroms in diameter through which cations can easily move. Mordenites containing various alkali and alkali-earth cations can be prepared from sodium mordenite by ion exchange in an aqueous solution.

Most preferably, the ion-emission pellet of the ion or atom source of the invention is formed from anhydrous cesium mordenite, which has a unit cell chemical formula of $4(Cs_2O.Al_2O_3.10SiO_2)$. Anhydrous cesium mordenite powder has a purely ionic conductivity due almost entirely to the transport of cesium ions. The resistivity of anhydrous cesium mordenite is approximately equal to $10^{+4}$ ohm-cm at a temperature of 1000° C. The high degree of cesium ion mobility in the mordenite structure accounts for the high ionic conductivity.

If desired, the ion-emission pellet can comprise a combination of different zeolites, which can give rise to a source which produces a beam of a mixture of ions or atoms of different elements.

The ion-emission pellet can be of any size depending upon the intended use of the source. Preferably the pellet is cylindrical in shape, although other shapes can be used if desired. The ion-emission pellet is preferably formed by sintering a powdered electrolyte containing the desired ion or ions.

In preferred embodiments in which the ion-emission surface of the ion-emission pellet has a porous metal coating, the coating is most preferably composed of tungsten. Other metals which have a high melting point and a high work function may also be used, such as iridium, molybdenum, rhenium, osmium, platinum and their alloys. Best results in operating the source of the present invention are obtained when the ion-emission metal layers are porous and very thin. For example, porous tungsten layers about one micrometer thick are preferred, although a thickness of 10 micrometers or more may be used if a source with a longer lifetime is desired.

Metal layers can be applied to the ion-emission pellet by plasma sputtering using a magnetron sputtering source in a sputtering chamber. Using a low sputtering voltage and a high gas pressure in the sputtering chamber will tend to result in the deposition of film which is porous, because atoms that are deposited on the surface of the pellet will tend to have an energy which is too low to provide the surface mobility necessary for crystallization.

Both thin and thick layers of platinum and iridium can be applied to ion-emission pellets of the invention using organo-metallic pastes such as platinum paste "#6082" and iridium paste "#8057" manufactured by Engelhard Industries of Iselin, N.J. The paste is brushed onto the pellet, dried for about 15 minutes at about 125° C. in air and then fired at about 850° C. for about 10 minutes in air.

Other techniques for depositing layers of metals, porous or nonporous, known in the art can be used to deposit metal layers on the ion-emission pellet of the invention if desired. See, for example, J. L. Vossen and W. Kern, *Thin Film Processes,* Academic Press, New York, N.Y. (1978), Chps. II-1 to II-5.

Instead of being randomly porous, the ion-emission metal layer can be a micropatterned metal film which has a dense regular array of small, uniformly sized holes passing through it. The metal film is preferably made of one of the high melting-point, high-work-function metals listed above in connection with the randomly porous ion-emission metal layers. Preferably, the micropatterned metal film is several micrometers thick. Such a film can be deposited onto the ion-emission surface of the ion-emission pellet by known microcircuit fabrication techniques such as chemical vapor deposition, sputtering, or photochemical reactions. The holes in the metal film are preferably about one micrometer in diameter and pass straight through the film. Such holes can be etched through the metal film by conventional photolithographic processes employed in microcircuit fabrication. In embodiments employing micropatterned metal films, the beam transmission channel of the ion/atom source comprises the holes passing through the ion-emission metal layer.

In one embodiment of the invention, a multilayered, micropatterned film is used for field-aided ion emission. In this version, an ion-emission metal film on the ion-emission surface of the pellet is coated with an insulating layer preferably made of alumina or silica about 0.1 to about 1 micrometer thick and aligned with the ion-emission metal layer. The insulating layer is in turn coated with an ion-accelerating metal layer aligned with both previous layers. If a voltage of about 100 volts is applied between the two metallic films, a electric field of about $10^6$ to about $10^7$ volts/cm is created on the ion emission surface of the pellet. Such an electric field enhances ion emission from the pellet.

The ratio of ions to atoms of an ionizable element such as an alkali or alkali-earth element present within a porous ion-emission metal layer is dependent upon the temperature of the metal layer according to the Saha-Langmuir equation:

$$a = \frac{g}{g_0} + \frac{(1 - r_i)}{(1 - r_0)} \exp \frac{e[\phi(T) - I]}{kT},$$

where a gives the ratio of the number of ions which passed per unit time from a surface of ion-emission metal layer to the number of atoms which are passed in the same time from the surface; $e\phi$ is the work function of the metal of the layer, which is dependent upon the temperature of metal layer; eI is the ionization energy of the ionizable element interacting with the metal; T is the temperature of the metal layer; $r_i$ and $r_o$ are reflection coefficients for the ion and atom respectively; and $g_+$ and $g_o$ are the statistical weights of the ionic and atomic states of the ionizable element, respectively.

The work function in the Saha-Langmuir equation depends on the temperature of the emission surface. If the temperature of ion-emission metal layer is higher than a certain critical temperature, most of the ionizable element in the ion-extraction metal layer is ionized. Thus, if the metal layer is maintained at a temperature substantially in excess of the critical temperature, most of the ionizable element which is passed from the metal layer is in the form of positive ions. If the metal layer is maintained at a temperature substantially below the critical temperature, most of the ionizable element which is passed from the metal layer is in the form of neutral atoms. As noted above, the critical temperature also depends on factors such as the porosity of the metal layer, the dimensions of the pores, and the rate at which ions pass into the metal layer.

Positive ions can be extracted from a space in front of the ion-emission metal layer by an ion-accelerating electric field. The energy of the ions generated by preferred sources of the invention is essentially independent of the thickness of the ion-emission pellet since the energy is primarily dependent upon the ion-accelerating electric field established between beam-forming electrode and the ion-acceleration electrode.

In order for an ion/atom source which incorporates a porous ion-emission metal layer to operate effectively as a source of atoms instead of ions, the temperature of the metal layer is maintained substantially below the critical temperature. If the temperature at the metal layer is maintained below the critical temperature, almost all of the alkali or alkali earth ions that pass into the ion-extraction metal layer accept electrons from the metal of the metal layer and leave the metal layer as uncharged atoms. The flux of the emitted atoms can be controlled with a flux-control electrode. By varying a flux-control potential difference between ion-emission metal layer and the flux-control electrode, the flux of ions emitted into the porous metal layer and hence the flux of atoms passing from the metal layer can be varied. The current flowing to the flux-control electrode is a measure of the flux of atoms which leave the metal layer.

BRIEF DESCRIPTION OF THE DRAWINGS

These and other objects, features, elements, and advantages of the invention will be apparent from the following description of the invention, in which.

DESCRIPTION OF THE PREFERRED EMBODIMENTS

Preferred embodiments of the ion/atom source of this invention are described in detail hereafter with reference to FIGS. 1 to 4. The same reference numbers are used for similar elements in each embodiment.

Figure 1:
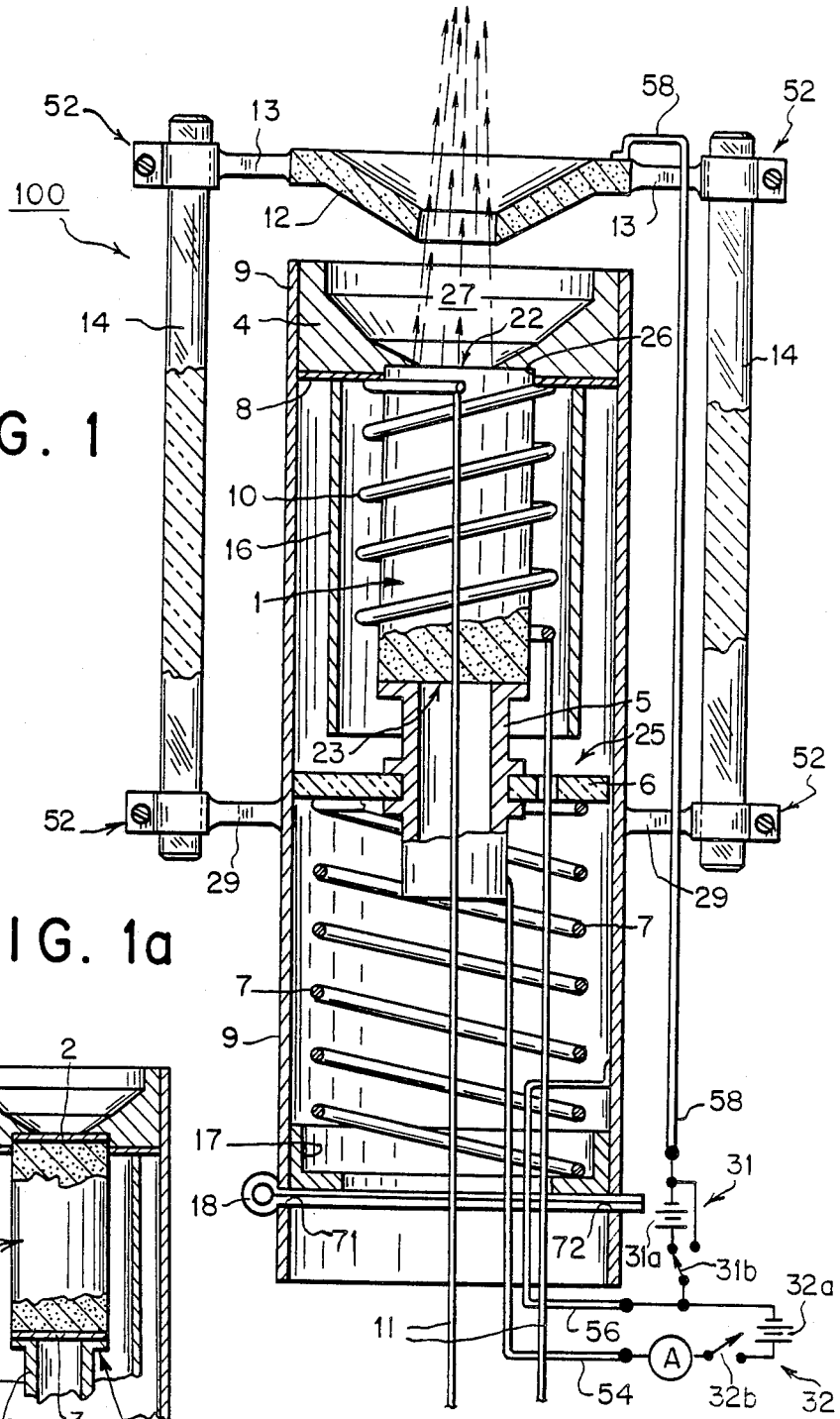
FIG. 1 is a cross-sectional view of a first embodiment of the solid state source of ions and atoms of the present invention.

FIG. 1 is a cross-sectional view of a solid state ion source 100 of the present invention. The ion source comprises an ion-emission pellet 1 of anhydrous cesium mordenite which is generally cylindrical in shape.

The cesium mordenite for the ion-emission pellet 1 can be prepared from sodium mordenite by the following ion exchange procedure. Synthetic sodium mordenite, a zeolite, is available from Union Carbide of Danbury, Conn. under the trade designation "LZ-M-5" as a powder consisting of crystals of about 5 to about 12 micrometers in diameter. An approximately two molar solution of CsCl in de-ionized water is prepared. About 100 gm of the sodium mordenite powder is added to about one liter of the CsCl solution. For every sodium ion in themordenite powder, there are about ten cesium ions available in the solution, so that an effectively complete ion exchange between the sodium ions in the mordenite and cesium ions from the solution is effected. The resulting mixture is maintained at a temperature of about 70° C. and stirred for about two days. This period of mixing ensures that there is an effectively complete cesium for sodium ion exchange in the powder. The liquid is then separated from the powder by filtration and the resulting cesium mordenite powder is dehydrated in a vacuum oven at a temperature of about 200° C.

The resulting anhydrous cesium mordenite powder is compacted without the use of a binder into a cylindrical shape by pressing with a metal die at a pressure of about 500 psi at room temperature. The pressing of the cesium mordenite powder is carried out in a dehumidified atmosphere in a glove box in order to prevent absorption of water by the powder.

The pressed cylindrical pellet is sintered in air using the following temperature cycle: heat to about 1250° C. at a rate of about 200° C./hr., dwell at about 1250° C. for about 15 minutes, cool to room temperature at a rate of about 200° C./hr. The linear shrinkage using this sintering process is about 12 percent.

Although the resulting sintered cesium mordenite pellet ordinarily has a sufficient surface finish to permit the end faces of the pellet to be coated directly by layers of tungsten, the ends are preferably polished using a polishing wheel covered with a thin layer of alumina or diamond particles of about 0.5 to about 1 micrometer in diameter.

Turning again to FIG. 1, the ion-emission pellet 1 has an ion-emission surface 22 and a flux-control surface 23 defined thereon. In this first embodiment 100 of the present invention, both the ion-emission surface 22 and the flux-control surface 23 are uncoated. The ion-emission surface 22 of ion-emission pellet 1 is pressed against an electrically-conducting beam forming electrode 4 by a compression assembly 25. The compression assembly 25 acts on the flux-control surface 23 of pellet 1 so that the ion-emission surface 22 of pellet 1 fits tightly into a recess 26 in the beam forming electrode 4 and makes electrical contact with the electrode. The beam forming electrode 4 is annular in shape and made of stainless steel. An aperture in the beam forming electrode 4 comprises a beam-transmission channel 27 through which an atom or ion beam can pass.

The compression assembly 25 comprises a tubular flux-control contact terminal 5, an annular piston 6 to which the contact terminal 5 is fixed, and a compression-assembly spring 7 which urges against the piston 6. The contact terminal 5 is made of nickel, the piston 6 is made of a ceramic material, and the compression assembly spring 7 is made of tungsten. The contact terminal 5 is electrically conducting and the annular piston 6, through which the contact terminal 5 passes, is electrically insulating. The contact terminal 5 presses against and makes electrical contact with the flux-control surface 23.

A heating filament 10 surrounds the ion-emission pellet 1 and is used to heat the pellet 1 to an ion-emission temperature at which ions are emitted from the pellet. The heating filament 10 is made of a tungsten wire with an alumina coating. The alumina coating provides electrical isolation for the tungsten wire. The heating filament 10 is electrically connected to a pair of heater-power supply leads 11 which pass through a pair of holes in the piston 6. The heating filament 10 is thermally shielded by stainless steel annular ring 8 and stainless steel cylindrical shield 16.

A stainless-steel sleeve 9 surrounds the beam forming electrode 4, the ion-emission pellet 1, the heating filament 10 and the compression assembly 25. The sleeve 9 is connected at one end to the beam-forming electrode 4. The piston 6 of the compression assembly 25 is free to slide within the sleeve 9.

An annular ion-acceleration electrode 12 is substantially coaxial with and spaced apart from the beam forming electrode 4. An aperture in the ion-acceleration electrode 12 is aligned with the aperture in the beam forming electrode 4. The ion-acceleration electrode 12 is attached to four radially-extending brackets 13 made of stainless steel. Each bracket 13 is supported by one of four glass rods 14. Four stainless-steel brackets 29 attach the glass rods 14 to the sleeve 9. Each of the brackets 13 and 29 has a split-ring clamp 52 at a radially outer end through which a glass rod 14 passes for securing the brackets 13 and 29 to the ends of the glass rods 14.

An annular retaining ring 17 secured by a pin 18 inserted into two opposite holes 71 and 72 in sleeve 9 compresses the spring 7 so that, in turn: the flux-control contact terminal 5 attached to the piston 6 is urged against the flux-control surface 23 on the ion-emission pellet 1, and ion-emission surface 22 on the pellet 1 is urged against the beam forming electrode 4.

Electrical leads 54, 56 and 58 are provided so that a potential difference may be applied by a flux-control voltage source 32 between the flux-control electrode 5 and the beam forming electrode 4 and a potential difference may be applied by an ion-accelerating voltage source 31 between the beam forming electrode 4 and the ion-acceleration electrode 12. The flux-control voltage source 32 includes a voltage generator 32*a* connected in series with an on-off switch 32*b* and a microammeter. The ion-accelerating voltage source 31 includes a voltage generator 31*a* connected in series with a one side of a double-throw switch 31*b*. The other side of the switch 31*b* is connected to a lead which by-passes the voltage generator 31*a*. A flux-control lead 54 is attached to the flux-control contact terminal 5 in order to permit a voltage to be applied to the flux-control surface 23 of ion-emission pellet 1. An ion-extraction-voltage lead 56 is attached to the sleeve 9 to provide a voltage to the beam forming electrode 4. An ion-acceleration voltage lead 58 is attached directly to ion-acceleration electrode 12.

In operation, the ion source 100 is placed in a vacuum and the heating filament 10 is provided with a current by filament leads 11 connected to a heater current source (not shown). The electrical current passing through heating filament 10 causes it to increase in temperature, thereby heating the ion-emission pellet 1. In this first embodiment 100, the ion-emission surface 22 and flux-control surface 23 of the pellet 1 are uncoated. The flux-control lead 54 is not connected to the voltage generator 32*a* so that the current return terminal 5 is electrically floating. The flux-control terminal 5 is only used for pressing the ion-emission surface 22 of the pellet 1 against the beam forming electrode 4. The electrical contact between the beam forming electrode 4 and the ion-emission surface 22 of pellet 1 ensures that the ion-emission surface 22 is approximately an equipotential surface regardless of the length of the pellet 1. The potential variation over the ion-emission surface 22 due to an ohmic potential drop along the surface generally has an insignificant effect on the operation of the source for many applications.

When the pellet 1 is heated by the filament 10, positive ions are thermionically emitted from the ion-emission surface 22 of the pellet 1 and are accelerated by the electric field produced by the potential difference applied between the ion-accelerating electrode 12 and the beam forming electrode 4. The ion-accelerating electrode 12 and the beam forming electrode 4 are shaped so as to produce a convergent flow of ions passing through the aperture in the ion-accelerating electrode 12. The design procedure described by J. R. Pierce, *Theory and Design of Electron Beams* (D. Van Nostrand 1954) may be commonly used to design the shape of electrodes for producing a space-charge-limited convergent ion flow. An ion-acceleration voltage difference is applied between the beam forming electrode 4 and the ion-accelerating electrode 12 with the ion-accelerating electrode 12 being negatively biased with respect to the beam forming electrode 4.

Typically, the cesium ion beam has a current density of about 1 mA/cm$^2$ when pellet 1 is heated to a temperature of about 1000° C. There are about $10^{21}$ cesium ions in a cesium mordenite pellet with a volume of about one cm$^3$. Such a pellet would thus be expected to have a lifetime of several hundred hours based upon an ion-beam current of about $10^{-3}$ mA.

Due to the potential variation over the ion-emission surface 22 noted above, the extracted ions will have an energy spread equal to the maximum potential difference over the ion-emission surface 22. It is estimated that the energy spread of the ions may be roughly 10 electron volts for a cesium-mordenite pellet having an ion-emission surface with an area of about 1 cm$^2$. Accordingly, in this first embodiment of the present invention, the ion source is suitable when there are no strict requirements on ion energy and focusing. The ion energy spread is essentially independent of the length of the pellet. This makes it possible to build ion sources with a lifetime of many hundred hours.

Figure 1A:
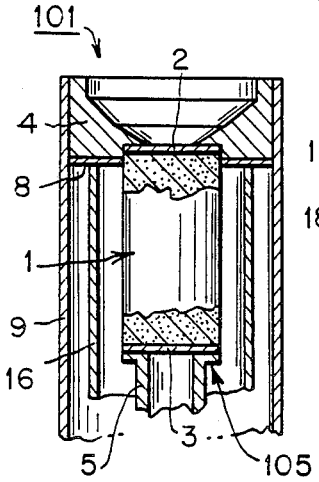
FIG. 1*a* is a partial cross-sectional view of another embodiment of the solid state source of ions of the present invention.

A second embodiment 101 of the present invention is shown in FIG. 1*a*. In order to simplify the illustration, FIG. 1*a* does not show the heating filament 10, the compression assembly 25, the ion-acceleration electrode 12 or its support structure. In the ion source 101, the ion-emission surface 22 is coated with an ion-emission metal layer 2 of porous tungsten, a refractory metal with a high work function. This layer is about 1 micrometer thick. The flux-control surface 23 is coated wirh a non-porous coating of tungsten to form a flux-control metal layer 3.

The porous tungsten layer can be applied to the ion-emission pellet 1 by using a magnetron sputtering with a tungsten cathode. A suitable magnetron is commercially available from Kurt J. Lesker Co., Pittsburgh, Pa. under the trade designation "KJL-HV-124-M." The magnetron is operated at a power of about 500 W and a frequency of about 13.5 MHz in an atmosphere of argon gas at a pressure of about 100 micrometers of Hg. The distance between the surface of the ion-emission pellet to be coated and the cathode of the magnetron is about 8 cm and the exposure time is about 10 minutes.

For the second embodiment 101, the switch 32*b* is closed and an ion-extraction voltage difference of about 10 to about 50 volts is applied between the ion-emission metal layer 2 and the metal layer 3, with the ion-emission metal layer 2 at the lower potential. The electric field produced by the ion-extraction voltage difference supplements the thermal ion flux and causes the positive cesium ions to diffuse within pellet 1 toward the ion-emission metal layer 2. Upon reaching the ion-emission metal layer 2, the cesium ions diffuse into the pores of the porous tungsten of which the ion-emission metal layer 2 is composed and interact with the tungsten.

Since the surface of the ion-emission metal layer 2 is essentially a true equipotential, the energy spread of the ions produced by the second embodiment 101 is very small compared to the energy spread of the ions produced by the first embodiment 100 in which the ion-emission surface 22 was uncoated. For example, when the pellet of the second embodiment 101 is heated to about 1000° C., the energy spread is approximately only about 0.1 eV, which is the thermal energy spread corresponding to an operating temperature of about 1000° C. Such a small energy spread makes it possible to produce very high quality ion beams that can be well focused.

In a third embodiment, the ion/atom source of FIG. 1*a* funtions as a source of a beam of neutral atoms. The pellet 1 of the ion source of the second embodiment of the present invention described above is maintained below a critical temperature of about 800° C. At this temperature, almost all of the cesium ions which pass into the ion-emission metal layer 2 from the ion-emission surface 22 are neutralized at the ion-emission metal layer 2 and leave as neutral cesium atoms. The switch 31*b* is set to the position in which the battery 31*a* is floating and the ion-acceleration electrode 12 is connected to the beam forming electrode 4. The aperture of the ion-acceleration electrode 12 serves to collimate a beam of the neutral atoms.

In the third embodiment, the contact terminal 5 and the flux-control metal layer 3 make up a flux-control electrode 105. Switch 32*b* of the flux-control voltage source 32 is closed so that a flux-control potential difference is applied between the flux-control electrode 105 and the ion-emission metal layer 12. The flux of atoms is controlled by the magnitude of the flux-control potential difference and can be monitored by monitoring the current flowing in the flux-control lead 54 connected to the flux-control electrode 105 with a microammeter.

Figure 2:
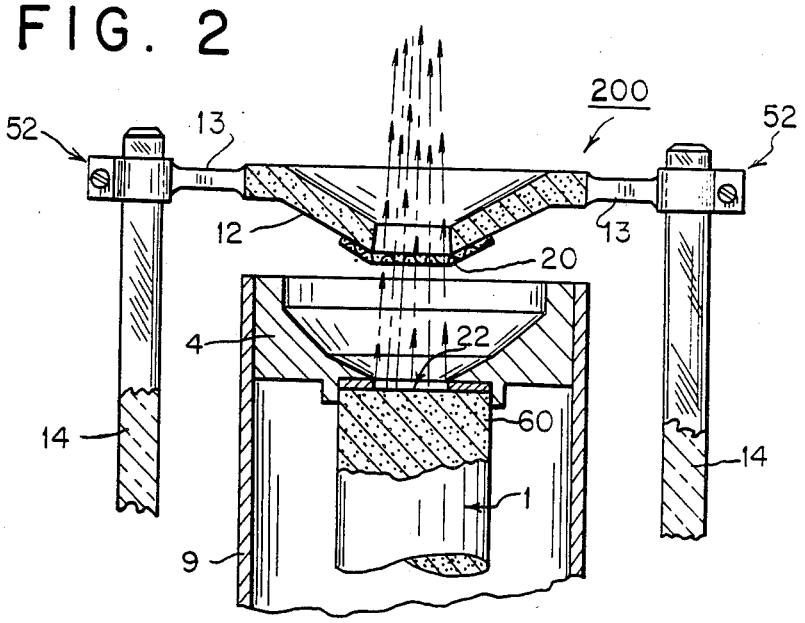
FIG. 2 is a partial cross-sectional view of another embodiment of the solid state source of ions of the present invention.

A fourth embodiment of an ion source 200 of the present invention is shown in the cross-sectional view of FIG. 2. In order to simplify the illustration, FIG. 2 does not show heating filament 10, the flux-control metal layer 3, or the compression assembly 25. In the ion source 200, the ion-emission end of pellet 1 is initially coated only on its outer perimeter with a thick annular, ion-extraction metal layer 60 made of tungsten. The inside diameter of annular ion-extraction metal layer 60 is preferably approximately equal to the inside diameter of the aperture passing through the annular beam forming electrode 4.

The aperture in the annular ion-acceleration electrode 12 is covered with an ion-acceleration mesh 20 made of tungsten or other high melting point, high-work function metal. A certain fraction (typically about 30 percent) of the ions emitted from the ion-emission pellet 1 will be intercepted by the ion-acceleration mesh 20. Thus a sufficient number of ions pass through the ion-acceleration mesh 20 to constitute an acceptable output flux for the ion source.

Ordinarily, when the kinetic energy of the ions accelerated to the aperture of the ion-acceleration electrode 12 is greater than about 100 eV, collisions between the accelerated ions and the tungsten ion-acceleration mesh 20 covering the aperture cause tungsten atoms to be sputtered from the mesh 20 onto ion-emission surface 22 of the ion-emission pellet 1. Thus a very thin coating of tungsten is deposited on the ion-emission surface 22. This thin tungsten coating aids in maintaining the entire ion-emission surface 22 at an essentially equal potential and thereby facilitates a uniform extraction of ions from the surface. Furthermore, the thin tungsten coating is ordinarily sufficiently porous to allow cesium ions to pass through. Because the tungsten coating is extremely thin, it is susceptible to rapid evaporation by oxidation. However, the coating is continuously rejuvenated during operation of the source by the constant sputtering of tungsten from the ion-acceleration mesh 20.

The annular metal layer 60 ensures a good contact between the thin layer of sputtered tungsten on the ion-emission surface 22 and the beam forming electrode 4.

Figure 3A:
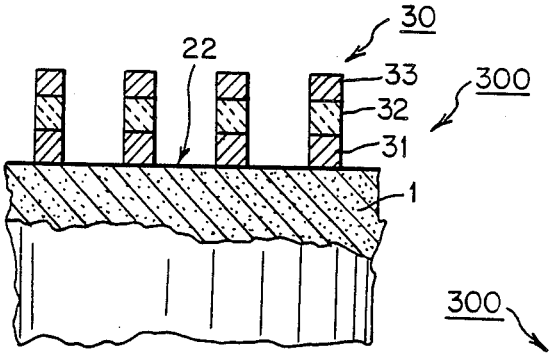
FIG. 3*a* is an enlarged partial cross-sectional view of another embodiment of the solid state source of ions and atoms of the present invention.
Figure 3B:
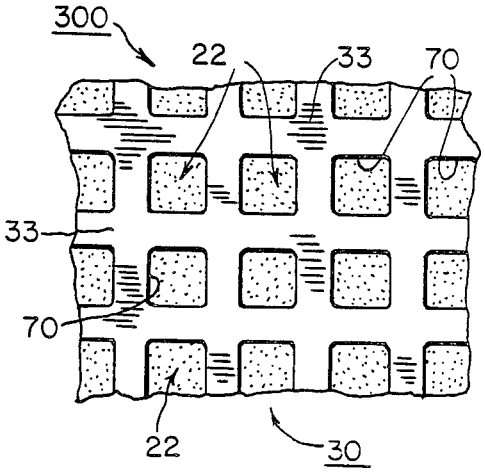
FIG. 3*b* is a top view of the embodiment of FIG. 3*a;*.

In a fifth embodiment of the ion source 300, shown in the partial cross-sectional view of FIG. 3*a* and the top view of FIG. 3*b*, a three-layered ion-emitting and accelerating grid 30 is fixed to the ion-emission surface 22 of the ion-emission pellet 1. A plurality of holes 70 pass through the three layers of the grid 30. The three layers of the ion-emitting and accelerating grid 30 are an emitting layer 31 located adjacent to the ion-emission surface 22 of the ion-emission pellet 1, an insulator layer 32 adjacent to the emitting layer 31, and an accelerating layer 33 adjacent to the insulator layer 32. The emitting layer 31 is made of tungsten and is about 1 micrometer thick. The insulating layer 32 is typically about 0.1 to about 1.0 micrometers thick and is made of a silica or alumina. The accelerating layer 33 is made of tungsten and is about 1 micrometer thick. The holes 70 which pass through the three layers 31, 32 and 33 are located on a square lattice with a lattice spacing of about 2 micrometers. The holes are approximately square with sides of about 1 micrometer. The plurality of holes 70 which pass through the ion-emitting and accelerating grid 30 make up the beam-transmission channel of the source 300.

In operation, a voltage difference of about 100 volts is applied between the emitting layer 31 and the accelerating layer 33 of the grid 30, thereby creating an electric field of about $10^6$ volts/cm at the ion-emission surface 22 of the pellet 1. This large electric field is sufficient to pull ions out of the pellet 1 with a velocity great enough that their momentum allows them to escape from the electric field and pass completely through the ion-emitting and accelerating grid 30 to form a directed ion beam. An ion depletion layer that forms near the ion-emission surface 22 of the pellet 1 as a result of the extraction of ions by the electric field causes ions from the reservoir of ions within the bulk of the pellet 1 to diffuse toward the ion-emission surface 22 of the pellet 1 from where they are extracted. As a result of the Schottky effect and field ionization, the large electric field also causes an increase in the "ionization efficiency" of the source. The ionization efficiency is a measure of the number of ions generated per atom. The large electric field also reduces a potential barrier at the surface which tends to oppose the emission of ions across the surface, thus making it possible for the source to be operated at a lower temperature than that necessary for the first embodiment of the ion/atom source of the invention shown in FIG. 1.

Figure 4:
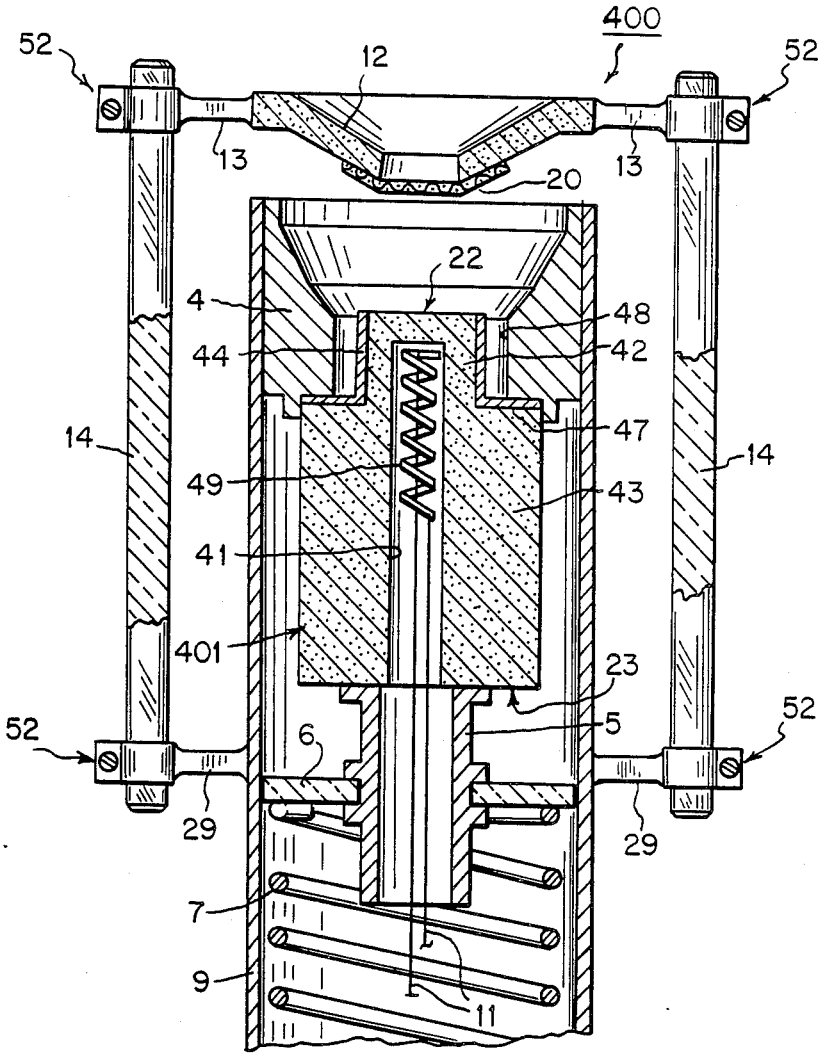
FIG. 4 is a partial cross-sectional view of another embodiment of the solid state source of ions and atoms of the present invention.

In a sixth embodiment of the ion source 400, shown in the partial cross-sectional view of FIG. 4, a heating filament 49 is inserted into a heater cavity 41 which extends generally into the ion-emission pellet 401. The heater cavity 41 is cylindrical in shape and is formed by drilling partially through the core of pellet 401 along its axis. For the ion source 400, the ion-emission pellet 401 comprises two sections: an emission section 42 and a reservoir section 43. The emission section 42 has a smaller diameter than the reservoir section 43. The sides of the emission section 42 and a step 47 between the emission section 42 and the reservoir section 43 are coated with a thick metal layer 44 that acts as a thermal shield and is impervious to ions from the electrolyte of which the pellet 1 is comprised. The metal layer 44 also provides an electrical contact between the pellet 401 and the beam forming electrode 4. The beam forming electrode 4 is shaped so that it contacts the metal layer 44 only at the step 47 between the emission section 42 and the reservoir section 43. An inside surface 48 of the aperture through the beam forming electrode 4 is cylindrical in shape and acts as a thermal shield or reflector. The cylindrical surface 48 helps to maintain the emission section 42 of the pellet 401 at the high temperature necessary for operation of the source 400. The ion-emission surface 22 of the pellet 401 is initially uncoated, but in operation becomes coated with a thin layer of sputtered tungsten from a tungsten mesh 20, as discussed above in connection with FIG. 2.

The flux-control surface 23 of the ion-emission pellet 401 at FIG. 4 is either uncoated or coated with a refractory metal and makes electrical contact with the contact terminal 5.

In operation, the emission section 42 acts as an ion emitter, while the reservoir section 43 acts as an ion reservoir. By inserting the heating filament 49 within pellet 401 as opposed to wrapping a heating filament around pellet 401, the heating power needed to operate the source is reduced by almost 50 percent.

While the present invention has been described in conjunction with specific embodiments, numerous alternatives, modifications, and variations will be apparent to those skilled in the art in light of the foregoing description.

For example, the ion-emission surface of the ion-emission pellet can be curved in shape. An ion-emission surface which is concave with a spherical concavity can serve to focus further a beam of emitted ions or atoms.

The beam forming electrode can be coated on the surface which contacts the ion-emission metal layer with a layer of the same metal of which the ion-emission metal layer is composed. Such a metal layer on the ion extraction terminal tends to minimize the amount of the metal from the ion-emission metal layer which diffuses into the beam-forming electrode.

An oven or a source of infrared radiation can be used to heat the ion-emission pellet.

The brackets 13 and 29 can be connected to the glass rods 14 by providing the brackets with outwardly flared ends and embedding the ends of the brackets in the glass rods by heating the ends of the rods and the brackets to above the softening point of the glass and pushing the ends of the brackets into the softened glass.

I claim:

1. A solid-state source of positive ions or atoms comprising:

(a) an essentially unitary ion-emission pellet capable of emitting positive ions at an ion-emission temperature, said pellet consisting essentially of an alkali or alkali-earth electrolyte that is solid at said ion-emission temperature, said pellet having a generally smooth ion-emission surface defined thereon from which ions can be emitted;

(b) a beam forming electrode for imposing an electrical potential on said ion-emission surface, the beam forming electrode having at least one passageway extending through it to define a beam-transmission channel through which an atom or ion beam can pass, the beam forming electrode being made of an electrically-conductive material which is mechanically stable at the ion-emission temperature;

(c) a pellet holder adapted to removably compressively mechanically hold said ion-emission pellet at a position and orientation such that the ion-emission pellet is in contact with the beam forming electrode at the ion-emission surface; and (d) heating means for heating said ion-emission pellet to said ion-emission temperature, so that when said pellet is heated to said ion-emission temperature by said heating means, positive ions are emitted from said ion-emission surface into the beam-transmission channel of the beam forming electrode and transmitted from the source as a beam of unneutralized positive ions or neutralized atoms.

2. The solid-state source of claim 1 further comprising:

(d) an ion-accelerating electrode for producing an ion-accelerating electric field to accelerate ions that enter the beam-transmission channel in the beam forming electrode, the ion-accelerating electrode being spaced apart from the beam forming electrode in a beam-transmission direction and having at least one passageway extending through it to define a beam-collimating channel through which an ion beam can pass, the ion-accelerating electrode being made of an electrically-conductive material which is mechanically stable at the ion-emission temperature;

(e) accelerating-electrode mounting means for maintaining a physical and electrical separation between the beam forming electrode and the ion-accelerating electrode, the accelerating-electrode mounting means being shaped to permit ions to pass from the beam-transmission channel of the beam forming electrode to the beam-collimating channel of the ion-accelerating electrode; and (f) accelerating-electrode electrical connector means electrically connected to the beam forming electrode and to the ion-accelerating electrode for electrically connecting an accelerating voltage source between the ion-beam forming electrode and the ion-accelerating electrode to impose an accelerating potential difference between the ion-accelerating electrode and the beam forming electrode with said ion-accelerating electrode at a lower potential than said beam forming electrode, so that when said pellet is heated to said ion-emission temperature by said heating means and said accelerating potential difference is imposed, positive ions emitted from said ion-emission surface into the beam-transmission channel of the ion-beam forming electrode are accelerated by said accelerating potential difference, pass through said beam-collimating channel of the ion-accelerating electrode and are discharged from the source as a beam of ions.

3. The source of claim 2 wherein:

the beam forming electrode is annular in shape, having an ion-extraction aperture which passes through it; and the ion-accelerating electrode is annular in shape having an ion-accelerating aperture which passes through it, said ion-accelerating aperture comprising the beam-collimating channel.

4. The source of claim 3 wherein said ion-accelerating aperture in the ion-accelerating electrode is covered by an ion-accelerating mesh comprised of an electrically conducting, high work function material.

5. The source of claim 9 further comprising:

(a)(i) an ion-extraction layer fixed to the ion-emission surface of said pellet, said ion-extraction layer being mechanically stable at the ion-emission temperature and being comprised of an electrically conducting material, said ion-extraction layer being generally annular in shape with the beam-transmission channel passing through the opening of the annulus.

6. The source of claim 2 wherein:

the beam forming electrode comprises a micropatterned ion-emission film fixed to the ion-emission surface of the pellet, said ion-emission film being comprised of a high work function, electrically conducting material and being provided with a plurality of holes which pass through it, the holes being of a size such that an ion or atom beam can pass through said holes;

the accelerating-electrode mounting means comprises a micropatterened insulating layer fixed to the ion-emission film on a surface that is not in contact with the ion-emission surface of the pellet, the insulating layer being comprised of an electrically insulating material and being provided with a plurality of holes which pass through it, said holes in said insulating layer being in register with and approximately the same size as said holes in said ion-emission film; and the ion-accelerating electrode comprises a micropatterend ion-accelerating film fixed to the insulating layer on a surface that is not in contact with the ion-emission film, the ion-accelerating film being comprised of an electrically conducting material and being provided with a plurality of holes which pass through it, said holes in said ion-emission film being in register with and approximately the same size as said holes in said insulating layer.

7. The source of claim 2 further comprising:

(a)(i) an ion-emission layer fixed to the ion-emission surface of said pellet, said ion-emission layer being mechanically stable at the ion-emission temperature and being comprised of an electrically conducting, high-work function material, the material being porous to the ions emitted by the pellet and to the corresponding atoms; and (g) electrical conductor means connected between the ion-accelerating electrode and the beam-forming electrode to maintain the two electrodes at substantially the same potential.

8. The source of claim 7 in which the ion-emission layer consists essentially of tungsten, iridium, molybdenum, rhenium, osmium, platinum or an alloy thereof.

9. The source of claim 1 further comprising:

(a)(i) an ion-emission layer fixed to the ion-emission surface of said pellet, said ion-emission layer being mechanically stable at the ion-emission temperature and being comprised of an electrically conducting material, said beam-transmission channel passing through the ion-emission layer.

10. The source of claim 9 wherein the ion-emission layer comprises a layer of high work function material, said layer being porous to ions or atoms.

11. The source of claim 10 in which the ion-emission layer consists essentially of tungsten, iridium, molybdenum, rhenium, osmium, platinum or an alloy thereof.

12. The source of claim 9 wherein the ion-emission layer comprises a micropatterned film of a high work function material that is impervious to ions or atoms and through which film passes a dense array of holes through which can pass said ions or atoms.

13. The source of claim 6 wherein the holes in the film have a diameter of about one micrometer.

14. The solid-state source of claim 1 in which the ion-emission surface is substantially planar.

15. The source of claim 1 further comprising:

(d) a flux-control electrode, the flux control electrode being in contact with a flux-control surface defined on the pellet at a position generally opposing said ion-emission surface, said flux-control electrode being comprised of an electrically conducting material which is mechanically stable at the ion-emission temperature;

(e) flux-control electrical connector means connected to the beam forming electrode and to the flux-control electrode for electrically connecting a voltage source between the beam forming electrode and the flux-control electrode to impose a flux-control potential difference between the two electrodes with said beam forming electrode at a lower potential than said flux-control electrode, so that when said pellet is heated to said ion-emission temperature by said heating means and said flux-control potential difference is imposed between said beam forming electrode and said flux-control electrode, positive ions within the pellet tend to migrate toward said ion-emission surface and be emitted from said ion-emission surface into the beam-transmission channel of the beam forming electrode.

16. The source of claim 15 in which the flux-control electrode comprises a layer of a refractory metal fixed to the flux-control surface of the ion-emission pellet.

17. The solid-state source of claim 1 in which the ion-emission surface is generally curved.

18. The solid-state source of claim 17 in which the ion-emission surface is substantially concave with a substantially spherical concavity.

19. The solid-state source of claim 1 in which the ion-emission surface has a polished finish.

20. The solid-state source of claim 1 in which a dimension of the ion-emission pellet in a direction generally normal to the ion-emission surface equals or exceeds a crosswise dimension of the ion-emission surface.

21. The source of claim 1 wherein said pellet is provided with a heating-cavity which passes partially through said pellet, said heating means extending into said heating-cavity, said pellet comprising:

(a)(i) an emission section having said ion-emission surface and an emission-section diameter, said heating-cavity passing partially through the emission section; and (a)(ii) a reservoir section adjoining the emission section and having a reservoir-section diameter, said reservoir-section diameter being greater than said emission-section diameter, said heating-cavity passing completely through said reservoir section, the reservoir section and the emission section forming a step at their junction.

22. The source of claim 21 further comprising:

(a)(iii) an electrically conducting layer covering and fixed to an annular surface at an axial end of the reservoir section adjoining the emission section and covering and fixed a radially outer surface of the emission section of the pellet, said electrically conducting layer being comprised of material that is impervious to the ions of the alkali or alkali earth electrolyte, the ion-emission surface of the pellet being not covered with the electrically conducting layer, said beam forming electrode being removably in contact with a portion of said electrically conducting layer.

23. The source of claim 22 wherein said beam forming electrode is annular in shape having a beam forming aperture which passes through it, the emission section of the pellet passing through said beam forming aperture.

24. The source of claim 1 in which the solid electrolyte of the pellet is a zeolite.

25. The source of claim 24 in which the solid electrolyte of the pellet is an alkali or alkali-earth mordenite.

26. The source of claim 25 in which the solid electrolyte of the pellet is cesium mordenite.

27. A solid-state source of positive ions or atoms comprising:

(a) an ion-emission pellet capable of emitting positive ions at an ion-emission temperature, said pellet consisting essentially of an alkali or alkali-earth electrolyte that is solid at said ion-emission temperature, said pellet having an ion-emission surface defined thereon from which ions can be emitted;

(b) a beam forming electrode in contact with said ion-emission pellet at said ion-emission surface for imposing an electrical potential on said surface, the beam forming electrode having at least one passageway extending through it to define a beam-transmission channel through which an atom or ion beam can pass, the beam forming electrode being made of an electrically-conductive material which is mechanically stable at the ion-emission temperature;

(c) heating means for heating said ion-emission pellet to said ion-emission temperature;

(d) a flux-control electrode, the flux control electrode being in contact with a flux-control surface defined on the pellet at a position generally opposing said ion-emission surface, said flux-conrol electrode being comprised of an electrically conducting material which is mechanically stable at the ion-emission temperature;

(e) flux-control electrical connector means connected to the beam forming electrode and to the flux-control electrode for electrically connecting a voltage source between the beam forming electrode and the flux-control electrode to impose a flux-control potential difference between the two electrodes with said beam forming electrode at a lower potential than said flux-control electrode, so that when said pellet is heated to said ion-emission temperature by said heating means and said flux-control potential difference is imposed between said beam forming electrode and said flux-control electrode, positive ions within the pellet tend to migrate toward said ion-emission surface and be emitted from said ion-emission surface into the beam-transmission channel of the beam forming electrode and transmitted from the source as a beam of unneutralized positive ions or neutralized atoms;

(f) a tubular electrode mounting sleeve comprised of an electrically conducting material within which mounting sleeve the beam forming electrode is fixed and the flux-control electrode is removably mounted, the ion-emission pellet being removably mounted within the mounting sleeve between the beam forming electrode and the flux-control electrode, the flux-control electrode being electrically isolated from the mounting sleeve; and (g) resilient means acting upon the flux-control electrode to urge the ion emission pellet against the beam forming electrode.

28. A solid-state source of positive ions or atoms comprising:

(a) an ion-emission pellet capable of emitting positive ions at an ion-emission temperature, said pellet consisting essentially of an alkali or alkali-earth electrolyte that is solid at said ion-emission temperature, said pellet having an ion-emission surface defined thereon from which ions can be emitted;

(b) a beam forming electrode in contact with said ion-emission pellet at said ion-emission surface for imposing an electrical potential on said surface, the beam forming electrode having at least one passageway extending through it to define a beam-transmission channel through which an atom or ion beam can pass, the beam forming electrode being made of an electrically-conductive material which is mechanically stable at the ion-emission temperature;

(c) heating means for heating said ion-emission pellet to said ion-emission temperature, so that when said pellet is heated to said ion-emission temperature by said heating means, positive ions are emitted from said ion-emission surface into the beam-transmission channel of the beam forming electrode and transmitted from the source as a beam of unneutralized positive ions or neutralized atoms;

(d) an ion-accelerating electrode for producing an ion-accelerating electric field to accelerate ions that enter the beam-transmission channel in the beam forming electrode, the ion-accelerating electrode being spaced apart from the beam forming electrode in a beam-transmission direction and having at least one passageway extending through it to define a beam-collimating channel through which an ion beam can pass, the ion-accelerating electrode being made of an electrically-conductive material which is mechanically stable at the ion-emission temperature;

(e) accelerating-electrode mounting means for maintaining a physical and electrical separation between the beam forming electrode and the ion-accelerating electrode, the accelerating-electrode mounting means being shaped to permit ions to pass from the beam-transmission channel of the beam forming electrode to the beam-collimating channel of the ion-accelerating electrode, the accelerating-electrode mounting means comprising:

(e)(i) a plurality of accelerating electrode mounting brackets connected to the ion-accelerating electrode;

(e)(ii) a like number of mounting sleeve brackets connected to the mounting sleeve;

(e)(iii) a like number of glass rods extending respectively between the accelerating electrode mounting brackets and the mounting sleeve brackets; and (e)(iv) attachment means for connecting each accelerating electrode mounting bracket and each mounting sleeve bracket to a glass rod;

(f) accelerating-electrode electrical connector means electrically connected to the beam forming electrode and to the ion-accelerating electrode for electrically connecting an accelerating voltage source between the ion-beam forming electrode and the ion-accelerating electrode to impose an accelerating potential difference between the ion-accelerating electrode and the beam forming electrode with said ion-accelerating electrode at a lower potential than said beam forming electrode, so that when said pellet is heated to said ion-emission temperature by said heating means and said accelerating potential difference is imposed, positive ions emitted from said ion-emission surface into the beam-transmission channel of the ion-beam forming electrode are accelerated by said accelerating potential difference, pass through said beam-collimating channel of the ion-accelerating electrode and are discharged from the source as a beam of ions;

(g) a flux-control electrode, the flux control electrode being in contact with a flux-control surface defined on the pellet at a position generally opposing said ion-emission surface, said flux-control electrode being comprised of an electrically conducting material which is mechanically stable at the ion-emission temperature;

(h) flux-control electrical connector means connected to the beam forming electrode and to the flux-controller electrode for electrically connecting a voltage source between the beam forming electrode and the flux-control electrode to impose a flux-control potential difference between the two electrodes with said beam forming electrode at a lower potential than said flux-control electrode, so that when said pellet is heated to said ion-emission temperature by said heating means and said flux-control potential difference is imposed between said beam forming electrode and said flux-control electrode, positive ions within the pellet tend to migrate toward said ion-emission surface and be emitted from said ion-emission surface into the beam-transmission channel of the beam forming electrode;

(i) a tubular electrode mounting sleeve comprised of an electrically conducting material within which mounting sleeve the beam forming electrode is fixed and the flux-control electrode is removably mounted, the ion-emission pellet being removably mounted within the mounting sleeve between the beam forming electrode and the flux-control electrode, the flux-control electrode being electrically isolated from the mounting sleeve; and (j) resilient means acting upon the flux-control electrode to urge the ion emission pellet against the beam forming electrode.

* * * * *